US005180031A

United States Patent [19]

Smith

[11] Patent Number: 5,180,031

[45] Date of Patent: Jan. 19, 1993

[54] GARDENER'S AID FOR SLOPED GROUND

[76] Inventor: Daniel S. Smith, 6004 S. Atlanta Ct., Tulsa, Okla. 74105

[21] Appl. No.: 625,904

[22] Filed: Dec. 11, 1990

[51] Int. Cl.[5] ..... E06C 1/00

[52] U.S. Cl. ..... 182/194; 182/45; 182/230; 182/107; 182/109

[58] Field of Search ..... 182/45, 194, 107, 108, 182/109, 111, 230

[56] References Cited

U.S. PATENT DOCUMENTS

| | | | |
|---|---|---|---|
| D. 248,875 | 8/1978 | Warren et al. | D25/99 |
| 368,199 | 8/1887 | Edgar | 182/111 X |
| 505,343 | 9/1893 | Austin | 182/45 X |
| 1,478,682 | 12/1923 | Stanberry | 182/45 |
| 1,600,572 | 9/1926 | Bauer | 182/107 X |
| 2,021,017 | 11/1935 | Ortell | 182/107 |
| 2,127,035 | 8/1938 | Kirlin | 182/107 |
| 2,419,065 | 4/1947 | Fowler | 182/107 X |
| 2,476,401 | 7/1949 | Champion | 182/45 |
| 3,566,992 | 3/1971 | Berger | 182/228 |
| 3,621,936 | 11/1971 | Andreassen | 182/194 |
| 3,638,759 | 2/1972 | Englhardt | 182/194 |
| 3,791,485 | 2/1974 | Norlander | 182/106 |
| 3,856,113 | 12/1974 | Engvall et al. | 182/194 |
| 3,944,024 | 3/1976 | Adas | 182/194 |
| 3,949,836 | 4/1976 | Russo | 182/194 |
| 4,060,150 | 11/1977 | Hughes | 182/151 |
| 4,121,377 | 10/1978 | Allen et al. | 182/194 |
| 4,135,605 | 1/1979 | Matherne | 182/194 |
| 4,193,477 | 3/1980 | Broyles | 182/194 |
| 4,204,587 | 5/1980 | Larson | 182/228 |
| 4,228,872 | 10/1980 | Treitz | 182/194 |
| 4,230,202 | 10/1980 | Kudra, III | 182/45 |
| 4,232,760 | 11/1980 | Becht et al. | 182/194 |
| 4,261,436 | 4/1981 | Stillman | 182/194 |
| 4,537,283 | 8/1985 | Humes | 182/127 |
| 4,595,075 | 6/1986 | Rodrigue | 182/70 |
| 4,603,758 | 8/1986 | Pettit | 182/194 |
| 4,632,219 | 12/1986 | Rayer | 182/45 |
| 4,646,877 | 3/1987 | Wlan | 182/45 |

*Primary Examiner*—Alvin C. Chin-Shue
*Attorney, Agent, or Firm*—Head & Johnson

[57] ABSTRACT

A gardener's aid for sloped ground formed of first and second elongated paralleled spaced apart strut members, a plurality of generally flat spaced apart paralleled support members each having one end affixed to a first strut member and the other end affixed to the other strut member, the support members being in planes parallel to each other and at an acute angle to the longitudinal axis of the strut members, and first and second arm members affixed at one end of the first and second strut members, the arm members extending in a plane substantially perpendicular to the plane of the strut members longitudinal axii, the gardener's aid being positionable on sloped ground so that the support members are generally horizontal providing surfaces for receiving the feet, knees or hands of users, the arm members serving to contact the sloped ground and support the strut members and support members above and generally parallel to sloped ground.

3 Claims, 2 Drawing Sheets

Fig. 1
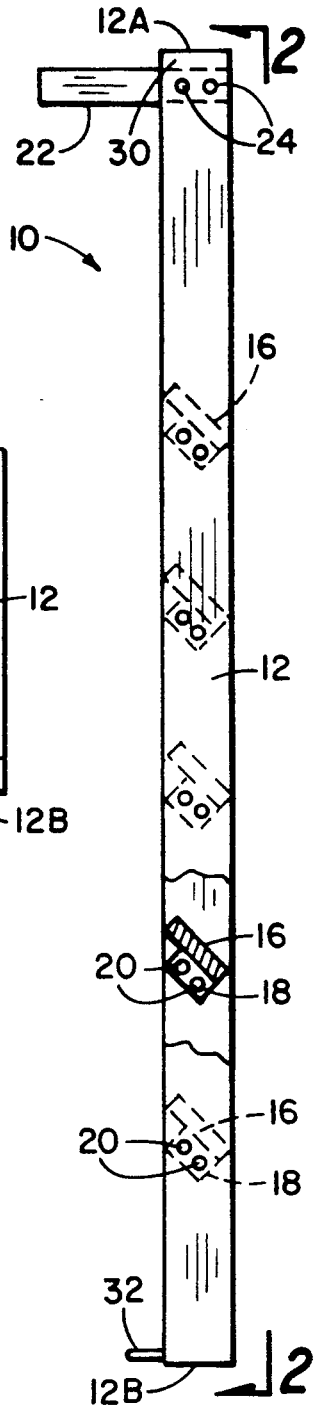
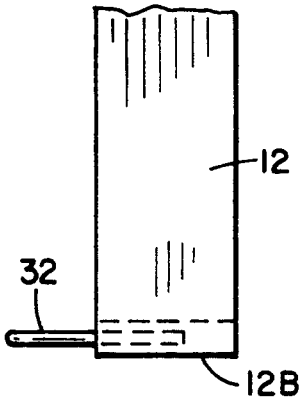
Fig. 4
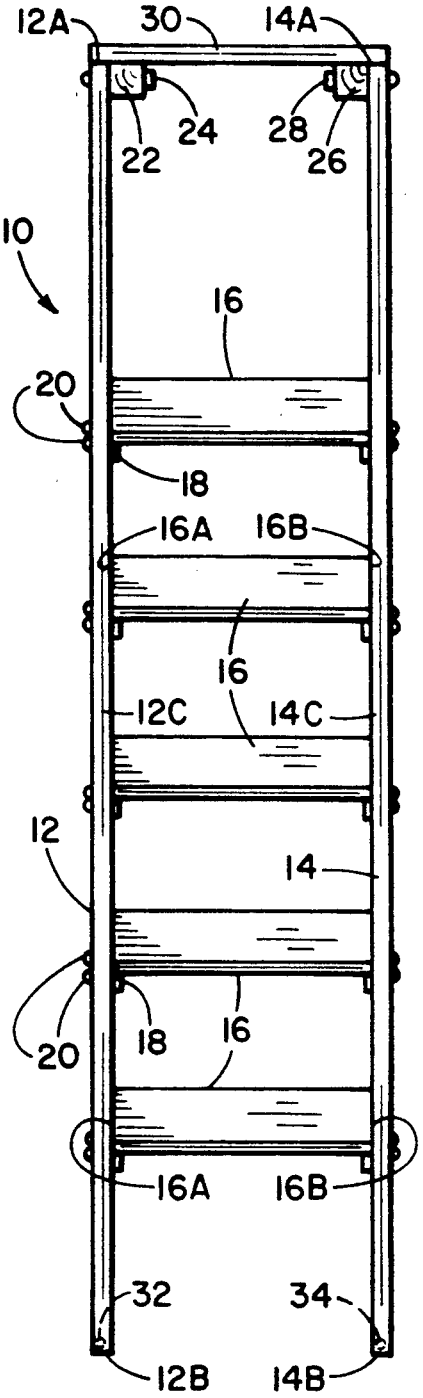
Fig. 2
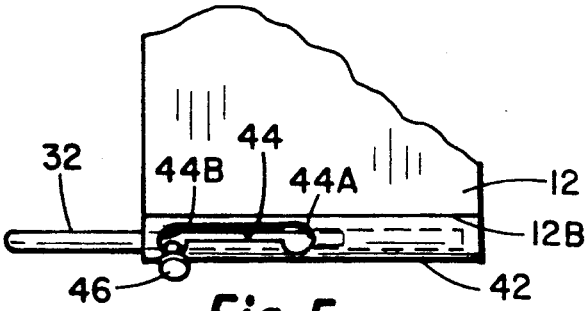
Fig. 5

GARDENER'S AID FOR SLOPED GROUND

SUMMARY OF THE INVENTION

Gardeners have always experienced difficulty in attending to hillsides and other sloped areas. Not only is it difficult for gardeners to stand and work on sloped areas, but usually such areas are fragile as far as plant life is concerned, and, therefore, walking on such areas is detrimental to the plant life and hazardous to the garden.

The present disclosure is related to a gardener's aid for sloped ground. The gardener's aid is formed of first and second elongated linear strut members. The strut members are spaced apart from and generally parallel to each other. Each of the strut members has a first and a second end and each has a longitudinal axis.

A plurality of generally flat spaced apart support members are positioned between the strut members. Each support member has one end affixed to the first strut member and the other end affixed to the second strut. The support members are thereby held in planes parallel to each other and at an acute angle to the longitudinal axis of each of the strut members.

First and second arm members are affixed respectively to the first and second strut members adjacent the first ends thereof. Each of the arm members extend in a plane substantially perpendicular to the plane of the strut members longitudinal axii.

The gardener's aid is positionable on sloped ground so that the support members are generally horizontal providing surfaces for receiving the feet, knees or hands of the user. The arm members, extending from the strut members, serve to support the strut members above the ground and generally parallel to the sloped ground.

In a preferred embodiment the gardener's aid includes retention pins affixed to each of the strut members adjacent the second ends thereof. The retention pins are preferably retractable and moveable between a storage position and an operating position wherein the pins extend perpendicular to the strut members. The pins, in the operating position, penetrate the ground on which the gardener's aid is used to help prevent it from sliding down sloped ground as it is being used.

In addition, in the preferred embodiment the arm members are pivotally affixed to the strut members. The arm members are pivotal between a storage position wherein they are parallel to the strut members longitudinal axii and an operating position wherein they extend perpendicular to the strut members.

For background material relating to apparatuses which have somewhat similar structures but which fail to teach the concepts and the benefits of the gardeners aid for sloped ground of this disclosure, reference may be had to the following previously issued U.S. Pat. Nos. 4,603,758; 4,537,283; 4,261,436; 4,232,760; 4,230,202; 4,228,872; 4,204,587; 4,193,477; 4,135,605; 4,121,377; 4,060,150; 3,949,836; 3,944,024; 3,856,113; 3,791,485; 3,638,759; 3,621,936; 3,566,922; 4,595,075; D248,875 and 4,121,377.

DESCRIPTION OF THE DRAWINGS

FIG. 1 is an elevational side view of a gardener's aid for sloped grounds which employs the principles of this disclosure.

FIG. 2 is a plan top view of the gardener's aid as taken along the line 2—2 of FIG. 1.

FIG. 4 is a fragmentary elevational end view showing the employment of a pin member to aid in preventing the gardener's aid from sliding down steeply sloped ground.

FIG. 5 is an enlarged view of the pin member arrangement of FIG. 4 showing means of locking the pin in an operating position or a stored position.

DESCRIPTION OF THE PREFERRED EMBODIMENT

Figure 3:
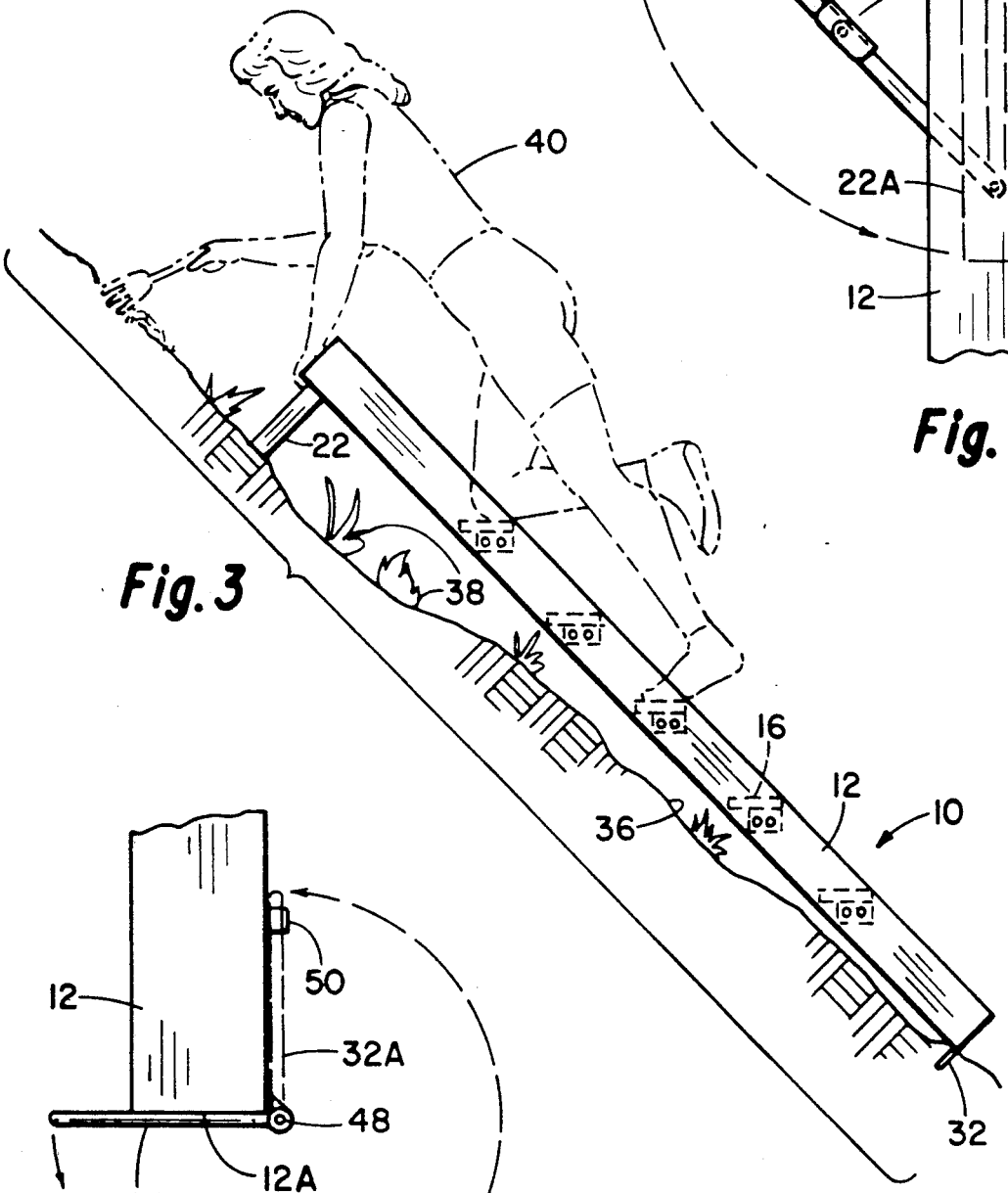
FIG. 3 is an elevational view of the gardener's aid of this disclosure shown in application on sloped ground and with a gardener in dotted outline showing how the gardener's aid is used.

Referring to the drawings and first to FIGS. 1, 2 and 3, a gardener's aid for sloped ground is generally indicated by the numeral 10. The gardener's aid includes a first elongated linear strut member 12 and a second elongated linear strut member 14. The strut members have first ends 12A and 14A respectively and second ends 12B and 14B. The strut members 12 and 14 are preferable generally parallel to each other, as is illustrated in FIG. 2, and each has a longitudinal axis 12C and 14C.

Positioned between strut members 12 and 14 are a plurality of generally flat spaced apart support members 16. The support members each has a first end 16A and a second end 16B. The first end 16A of each of the support members is affixed to first strut member 12, and the second end 16B of each of the support members is affixed to second strut member 14. Attaching support members 16 to strut members 12 and 14 can be accomplished in a variety of ways. In the way illustrated, angular clips 18 that receive bolts 20 are employed.

Support members 16 are spaced apart from each other and in planes parallel to each other. The planes of support members 16 are at an acute angle relative to the longitudinal axii 12C and 14C of strut members 12 and 14.

A first arm member 22 is affixed to first strut member 12 adjacent first end 12A and extends perpendicular to longitudinal axis 12C of the first strut member. As illustrated in FIGS. 1 and 2, first arm member 22 is attached to first strut member 12 by means of bolts 24. First arm member 22 has a blunt outer end 22B as seen best in FIG. 7 to resist ground penetration.

In like manner, a second arm member 26 is secured to second strut member 14 adjacent first end 14A thereof. Bolts 28 are illustrated as a means of retaining second arm member 26 to second strut member 14. Arm member 26 has a blunt outer end to resist ground penetration, the same as arm member 22.

A bracket member 30 is secured to the strut members at ends 12A and 14A thereof to function as a structural support.

As shown in FIGS. 1, 2, 3 and 4, a retention pin 32 is affixed to first strut member 12 adjacent second end 12B. In like manner, a retention pin 34 is affixed to second strut member 14 adjacent second end 14B.

The function of retention pins 32 and 34 is to penetrate the ground and help prevent the gardener's aid device 10 from sliding down hill on sloped ground while it is being used.

FIG. 3 illustrates the use of gardener's aid 10 on sloped ground 36. Ground 36 has plants 38 that require attending. A gardener, illustrated in dotted outline and indicated by the numeral 40, is shown employing gardener's aid 10 on sloped ground 36. Support members 16 provide substantially horizontal surfaces to receive the feet, knees, or hands of gardener 40, permitting the gardener to work on plants 38 without having to stand on sloped ground 36. Arms 22 and 26 support strut members 12 and 14 above sloped ground 36 and retention pins 32 and 34 help prevent gardener's aid device 10 from sliding down hill.

FIG. 5 shows an alternate arrangement for the retention pins. Affixed to the second end 12B of first strut 12 is a tubular member 42 that slidably receives retention pin 32. Tubular member 42 has a slot 44 cut therein with laterally extending slot portions 44A and 44B. Affixed to pin 32 and extending radially therefrom is a bolt 46 that is slidable in slot 44 and positionable in either of the lateral extensions 44A or 44B.

In the position illustrated in FIG. 5 retention pin 32 is slid to the operating position where it extends outwardly from strut member 12 with bolt 46 in slot laterally extending portion 44B. When gardener's aid device 10 is not in use, retention pin 32 can be retracted by moving bolt 44 to slot laterally extending portion 44A.

Figure 6:
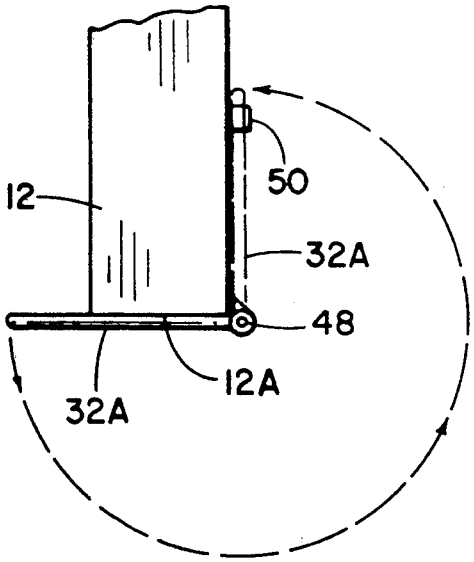
FIG. 6 is a fragmentary end view of the gardener's aid showing an alternate arrangement for a pin member and showing the pin member in solid outline in the operating position and in dotted outline in the stored position.

FIG. 6 shows an alternate embodiment of providing a retention pin in which the pin is pivotal between an operating position and a stored position. Retention pin 32A is pivotally secured at 48 to strut member 12 at end 12A. Retention pin 32A can be pivoted to an operating position, as shown in solid outline, wherein the pin extends parallel to and in contact with strut member first end 12A. The pin can be rotated to a storage position, as shown in dotted outline, wherein pin 32A is parallel to strut member 12. To retain pin 32A in the stored position a clip 50 is employed.

Figure 7:
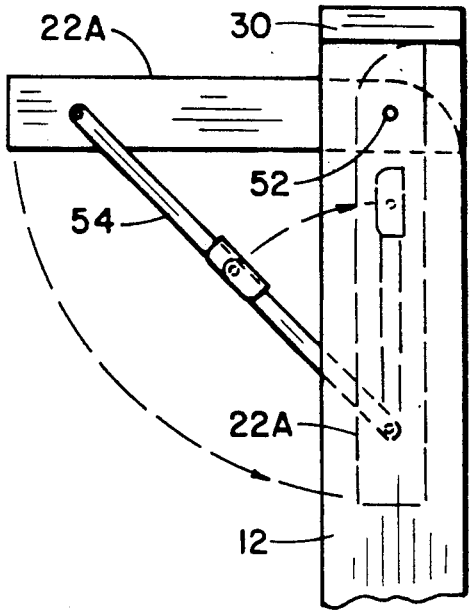
FIG. 7 is a fragmentary elevational view of the upper end of a strut member illustrating an arm member pivotally secured to the strut member and showing the arm member in solid outline in operating position and in dotted outline in storage position.

FIG. 7 shows an arrangement for pivotally supporting the arm members to the strut members. In FIG. 7 arm member 22A is pivotally attached to first strut member 12 about a pivot bolt 52. The arm is shown in an operating position in solid outline and in the storage position in dotted outline. In the operating position arm 22A extends perpendicular to strut member 12, and in the stored position is parallel to the strut member.

A pivoting bracket 54 is used to retain arm 22A in the operating position; the bracket 54 pivoting to allow the arm to be moved to the stored position.

With the use of pivoting arms, as shown in FIG. 7 and retractable or pivotal retention pins as shown in FIGS. 5 and 6, the gardener's aid is a compact device when in the storage mode. It is quickly changed to the operating mode by extending the arms and the retention pins. The gardener's aid provides a convenient and easy to use apparatus for sloped ground. The device substantially increases the safety of the gardener working on sloped ground and reduces the likelihood of damage to plant life.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A gardner's aid for use on sloped ground to support a gardener in close proximity to sloped ground, comprising:

a first and second elongated linear strut members spaced apart from and generally parallel to each other, each having a first end and a second end and each having a longitudinal axis;

a plurality of generally flat spaced apart support members, each support member having one end affixed to said first strut member and the other end affixed to said second strut member, the support members being in planes paralleled to each other and at an acute angle to the longitudinal axis of each of said strut members;

first and second arm members affixed respectively to said first and second strut members adjacent said first ends thereof, said arm members extending in a plane substantially perpendicular to the plane of the strut members longitudinal axii and being of relative short length compared to the length of said strut members, each arm member having a blunt outer end spaced from said strut member to resist ground penetration, the gardener's aid being positionable on sloped ground whereby said support members are generally horizontal providing surfaces for receiving the feet, knees or hands of the user, said strut members second ends serving to contact sloped ground and to support said strut members and said support members above and generally parallel to and in close proximity with sloped ground; and a retractable retention pin affixed to each of said strut members adjacent said second ends thereof and moveable between an operating position and a storage position and when in the operating position the retention pins extending generally perpendicular to said longitudinal axis of each said strut member and serving to penetrate ground to aid in preventing the gardener's aid from sliding on sloped ground.

2. A gardener's aid according to claim 1 said arm members are pivotally affixed to said strut members and are each pivotal between a storage position in which it extends parallel to the strut member to which it is attached and an operating position in which it extends perpendicular to the strut member to which it is attached.

3. A gardener's aid according to claim 1 wherein each of said retention pin is hinged to said strut member and pivotal between a storage position in which each retention pin is parallel to said longitudinal axis of said strut member to which it is pivotally attached and an operating position in which each retention pin extends perpendicular to said longitudinal axis of said strut member to which it is attached.

* * * * *